US005365843A

United States Patent [19]

House et al.

[11] Patent Number: 5,365,843

[45] Date of Patent: Nov. 22, 1994

[54] PRINTING PRESS WITH WEB BREAKING ASSEMBLY

[75] Inventors: Harold B. House, Hope Valley, R.I.; Hubert J. Watson, Stonington, Conn.; Jeffrey S. Upchurch, Stratham, N.H.

[73] Assignee: Heidelberg Druckmaschinen AG, Heidelberg, Germany

[21] Appl. No.: 67,662

[22] Filed: May 26, 1993

[51] Int. Cl.[5] ..... B41F 5/04

[52] U.S. Cl. ..... 101/228; 101/219

[58] Field of Search ..... 101/224, 226, 227, 228, 101/180, 216, 219, 484; 226/11, 45; 225/4, 96

[56] References Cited

U.S. PATENT DOCUMENTS

| | | | |
|---|---|---|---|
| 2,653,536 | 9/1953 | Cooksey | 101/180 |
| 3,404,627 | 10/1968 | Halley | 101/228 |
| 3,439,848 | 4/1969 | Schwarzkopf | 225/96 |
| 3,605,618 | 9/1971 | Clasen | 101/228 |
| 3,620,110 | 11/1971 | Smith, Jr. | 83/66 |
| 4,261,285 | 4/1981 | Pearl | 101/26 |
| 4,676,159 | 6/1987 | Nawrath | 101/226 |
| 4,887,532 | 12/1989 | Kotterer | 101/225 |
| 5,067,402 | 11/1991 | Marx | 101/226 |

*Primary Examiner*—Ren Yan

*Attorney, Agent, or Firm*—Tarolli, Sundheim & Covell

[57] ABSTRACT

A web offset printing press (10) includes a motor and a gear train (106) for moving a web (14) along a path of movement extending through the press (10). The press (10) further includes an elongated punch member (130), a die member (30), and a pressure cylinder (112) for moving the punch member (130) back and forth between a retracted position and an extended position. The punch member (130) is spaced from the path of movement of the web (14) when in the retracted position, and extends across the path of movement of the web (14) and into an opening (122) in the die member (30) when in the extended position. The punch member (130) is moved from the retracted position to the extended position in response to detection of a fault condition by a web fault detecting assembly (100). The punch member (130) thus punches a hole (150) through the web (14) when a fault condition is detected in the web (14). The hole (150) in the web (14) enables the tension in the web (14) to tear the web (14) into separate sections (160, 162) so that lengthy sections of the web (14) do not become jammed in the press (10) when a fault condition arises.

4 Claims, 4 Drawing Sheets

PRINTING PRESS WITH WEB BREAKING ASSEMBLY

FIELD OF THE INVENTION

The present invention relates to a printing press for printing on a web of material, and particularly relates to a printing press having an assembly for intentionally breaking the web in the event of a fault, with the purpose of avoiding damage to the printing press, including the folder.

BACKGROUND OF THE INVENTION

A web offset printing press prints inked images on a web of material, such as paper, as the web is moved longitudinally through the press. Such a press typically includes a reel stand at one end of the press, a folder at the other end of the press, and a plurality of printing units arranged in a row extending between the reel stand and the folder. These components of the press include rotatable rollers and cylinders which move the web longitudinally through the press from the reel stand to the folder. The rollers in the reel stand control the tension in the web as the web is unwound from a supply roll in the reel stand. The cylinders in the printing units transfer the inked images onto the web as the web is moved from the reel stand through the printing units. The rollers and cylinders in the folder then fold and cut the printed web into signatures which are assembled into a finished product such as a book or magazine. The web or signatures can become wrapped around the rollers and cylinders and become jammed in the press if a fault condition in the web or signature flow, such as an unintentional break in the web or a loss of signature control, should arise during a printing operation. This can cause damage to the printing press, including the folder.

SUMMARY OF THE INVENTION

In accordance with the present invention, an apparatus for intentionally breaking a web moving in a printing press includes a punch member and a die member. The punch member has a longitudinal axis, a planar end surface extending across the axis, and a peripheral edge surface defining the peripheral shape of the end surface. The die member has a planar web guide surface and an inner edge surface defining a die opening at the planar web guide surface. A drive assembly moves the web along a path of movement extending across the planar web guide surface.

The apparatus further includes a pressure cylinder for moving the punch member back and forth between a retracted position and an extended position. The punch member is spaced from the path of movement of the web when in the retracted position. The punch member extends across the path of movement of the web and into the die opening when in the extended position.

A fault detecting assembly detects fault conditions in the web or signature flow when the web or signature is being moved along its path of movement by the drive assembly. An actuating assembly causes the pressure cylinder to move the punch member from the retracted position to the extended position in response to detection of a fault condition by the fault detecting assembly. The punch member then punches a hole through the web in the shape of the end surface of the punch member. The tension in the web is sufficient to tear the web transversely from the hole toward the longitudinal side edges of the web. The tension in the web thus tears the web into separate longitudinal sections. The interruption of web flow prevents or alleviates web or signature jams downstream of the web breaking apparatus.

BRIEF DESCRIPTION OF THE DRAWINGS

The foregoing and other features of the present invention will become apparent to those skilled in the art to which the present invention relates upon reading the following description in view of the accompanying drawings, in which.

DESCRIPTION OF A PREFERRED EMBODIMENT

Figure 1:
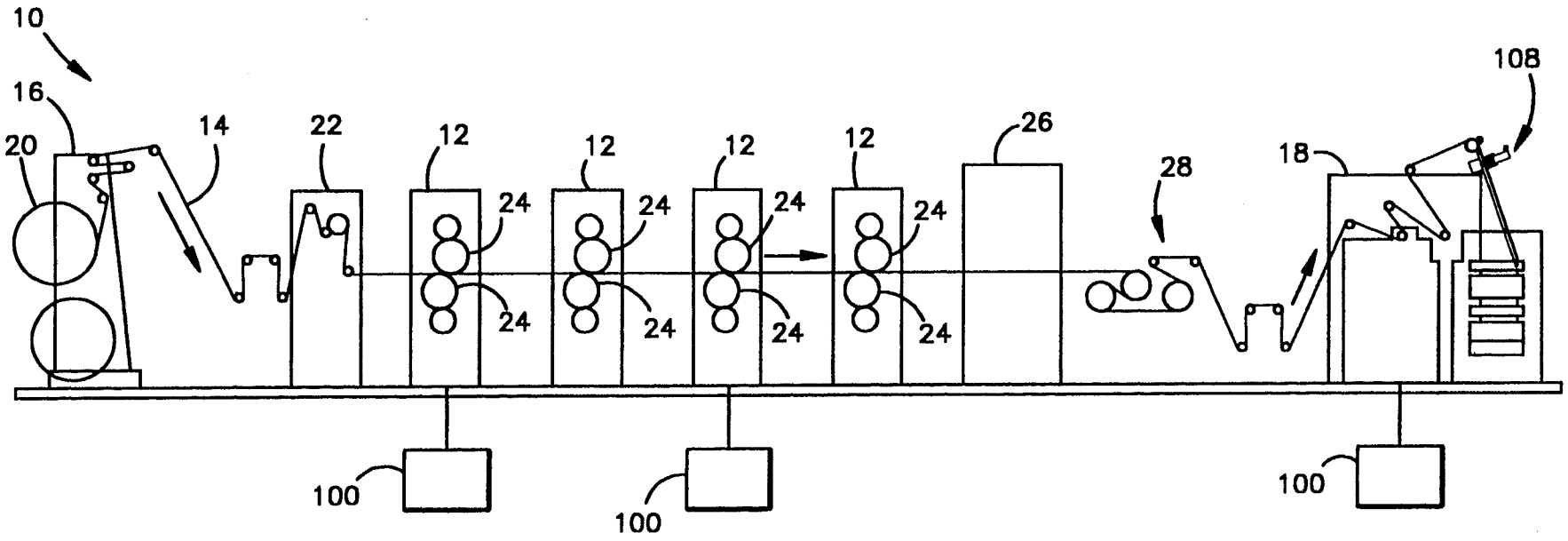
FIG. 1 is a schematic view of a web offset printing press constructed in accordance with the present invention.

A web offset lithographic printing press 10 constructed in accordance with the present invention is shown schematically in FIG. 1. The printing press 10 includes a plurality of printing units 12 for printing on opposite sides of a web 14. The web 14 extends longitudinally through the printing press 10 from a reel stand 16 at one end of the printing press 10 to a folder 18 at the other end of the printing press 10. The web 14 extends first from a roll 20 in the reel stand 16 to an infeed unit 22, and extends further from the infeed unit 22 to the printing units 12. Each of the printing units 12 includes printing cylinders 24 which transfer inked images to the opposite sides of the web 14 while the web 14 moves longitudinally through the printing unit 12. A dryer 26 sets the ink and dries the printed web 14, and a plurality of chill rolls 28 cool the web 14 as it emerges from the dryer 26. The folder 18 folds and cuts the web 14 to form signatures of a desired configuration for assembly into a finished product.

Figure 3:
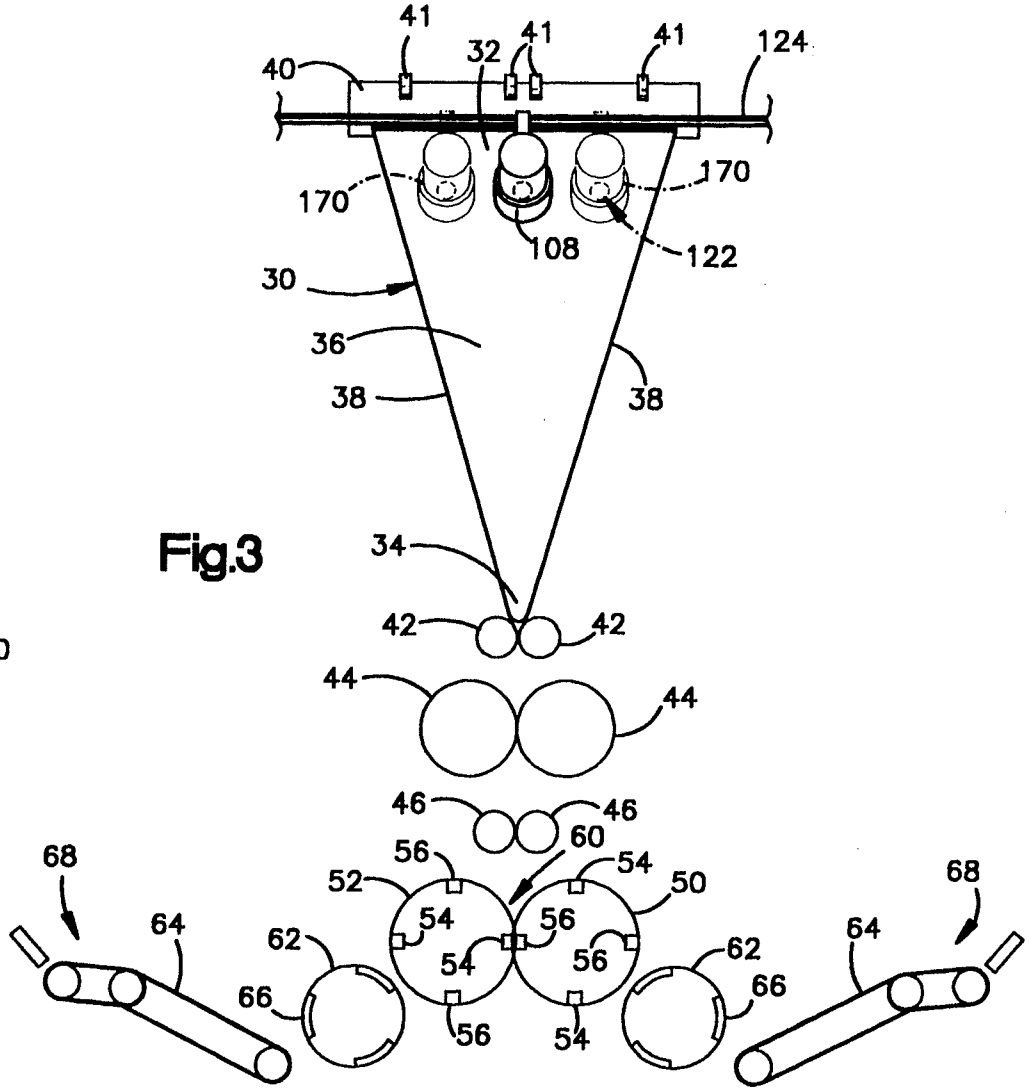
FIG. 3 is a view taken on line 3—3 of FIG. 2.
Figure 2:
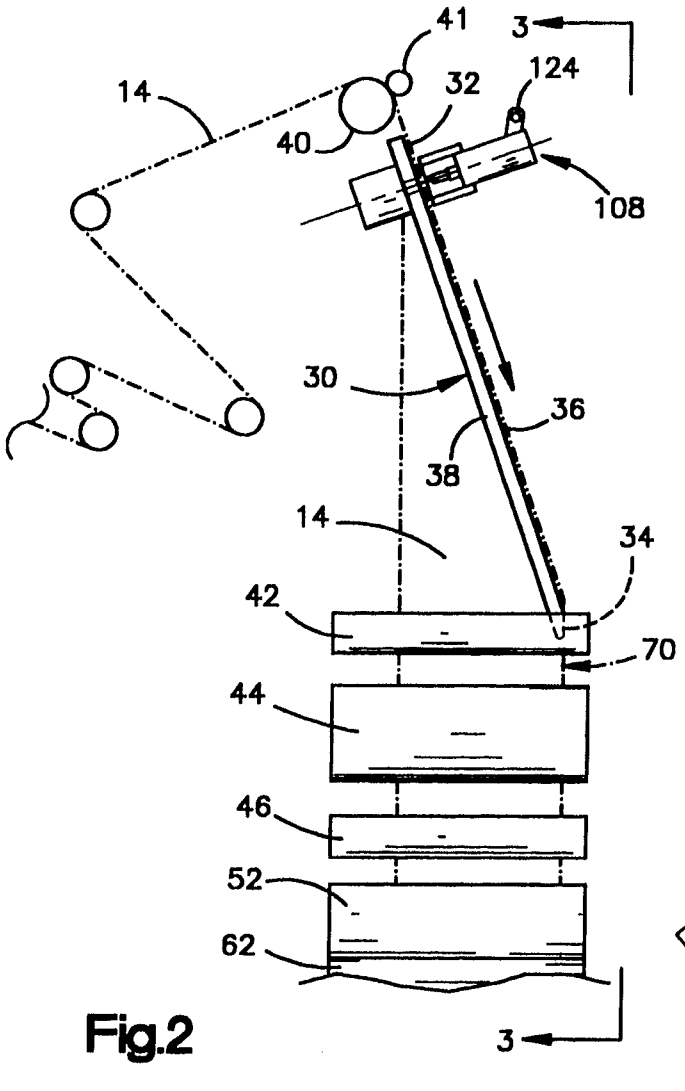
FIG. 2 is an enlarged partial view of part of the apparatus of FIG. 1.

The folder 18 is illustrated in greater detail in FIGS. 2 and 3. The illustrated folder 18 is merely representative. The present invention can be applied to a variety of different machines, including different folders and prefolders. The folder 18 includes a triangular former board 30 having a wide upper end portion 32 and a narrow nose 34 at its lower end portion. The former board 30 also has a triangular front surface 36 and a pair of opposite side surfaces 38 which converge downward from the upper end portion 32 toward the nose 34.

The folder 18 further includes a roller 40 adjacent to the upper end portion 32 of the former board 30, and a plurality of rollers 41 which cooperate with the roller 40. A pair of nip rollers 42 are located adjacent to the nose 34 of the former board 30. A pair of cross perforator rolls 44 and a pair of pinch rolls 46 are located below the former board 30.

A right hand transfer cylinder 50 and a left hand transfer cylinder 52 are located in the folder 18 below the pinch rolls 46. Each of the transfer cylinders 50 and 52 has a pair of cutting knife assemblies 54 and a pair of cutting block assemblies 56. Each cutting knife assembly 54 meets with a cutting block assembly 56 at the nip 60 between the transfer cylinders 50 and 52 when the transfer cylinders 50 and 52 rotate. Additionally, each of the transfer cylinders 50 and 52 is associated with a respective delivery cylinder 62 and a respective delivery belt 64. The delivery cylinders 62 have grippers 66 which operate in a known manner. The delivery belts 64 extend from the delivery cylinders 62 to delivery stations 68.

The web 14 extends through the folder 18 as shown in dashed lines in FIG. 2. The web 14 moves over the former board 30 from the roller 40 to the nip rollers 42 as indicated by the arrow shown in FIG. 2. A longitudinally extending fold 70 is formed in the web 14 as the web 14 moves downward across the former board 30. The nip rollers 42 press the fold 70 into the web 14 as the web 14 continues to move downward between the nip rollers 42.

The cutting knife assemblies 54 and the cutting block assemblies 56 on the transfer cylinders 50 and 52 cooperate at the nip 60 to cut the web 14 transversely across the web 14, and thus sever folded signatures from the web 14 as the web 14 moves downward through the nip 60. Each of the cutting assemblies 54 carries a severed signature to a gripper 66 on the associated delivery cylinder 62. The grippers 66 on the delivery cylinders 62 carry the signatures to the delivery belts 64 which, in turn, convey the signatures to the delivery stations 68.

The arrangement of rollers and cylinders above and below the former board 30 in the folder 18, as thus far described, is presented here as one example of a known arrangement of such parts of a folder. Those skilled in the art are familiar with folders having arrangements of rollers and cylinders that differ in accordance with the differing signatures produced by the folders. For example, folders are known to include fan delivery cylinders, cylinders which cut the web differently, and/or cylinders which form additional folds in the signatures. The present invention is also applicable to such folders having differing arrangements of rollers and cylinders.

Referring again to FIG. 1, the web 14 is maintained under controlled tension as it is moved longitudinally from the reel stand 16 to the folder 18. The tension in the web 14 is controlled primarily by the infeed unit 22, and generally to a lesser degree by each of the other components of the printing press 10 shown in FIG. 1. If the web 14 should break, the previously established control of the tension in the web 14 will be lost. Uncontrolled lengths of the web 14 could then become undesirably wrapped around one or more of the various rollers and cylinders in the printing press 10, or could otherwise accumulate or become jammed in the printing press 10.

In order to avoid the jamming problem described above, the printing press 10 further includes a plurality of fault detecting assemblies 100. The fault detecting assemblies 100 detect fault conditions such as web breaks or web or signature jams, and generate electrical signals upon detecting such fault conditions. The construction of such fault detecting assemblies is known in the art. As shown schematically in FIG. 1, the printing unit 10 includes fault detecting assemblies 100 that detect web fault conditions in the printing units 12, and further includes a fault detecting assembly 100 that detects web or signature flow fault conditions in the folder 18.

Figure 4:
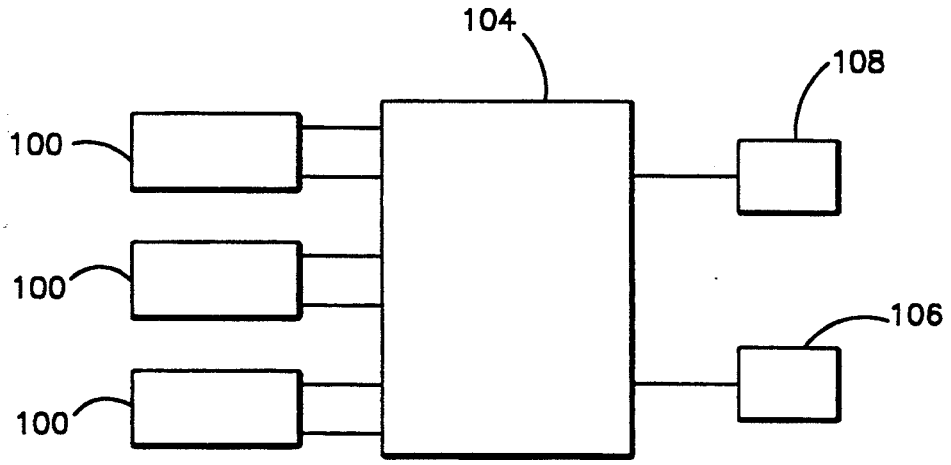
FIG. 4 is a schematic view of parts of the apparatus of FIG. 1.

As shown schematically in FIG. 4, the fault detecting assemblies 100 are further associated with a controller 104, a drive assembly 106, and a web breaking assembly 108. The drive assembly 106 also is of known construction, and includes a motor and a gear train for rotating the rollers and cylinders throughout the printing press 10. The controller 104 receives the electrical signals generated by the fault detecting assemblies 100, and responds by interrupting operation of the drive assembly 106 to stop movement of the web 14 through the printing press 10. The fault detecting assemblies 100, the controller 104 and the drive assembly 106 thus cooperate to prevent uncontrolled lengths of the web 14 from continuing to move around rollers or cylinders in the printing press 10 when tension in the web 14 has been lost as a result of a fault condition in the web 14 or signature flow.

As an additional precaution, the controller 104 further responds to the fault detecting assemblies 100 by actuating the web breaking assembly 108. The web breaking assembly 108 then breaks the web 14 to separate the web 14 into sections located on opposite sides of the web breaking assembly 108. In the preferred embodiment of the present invention, the web breaking assembly 108 is associated with the folder 18 to break the web 14 at a location within the folder 18.

Figure 5:
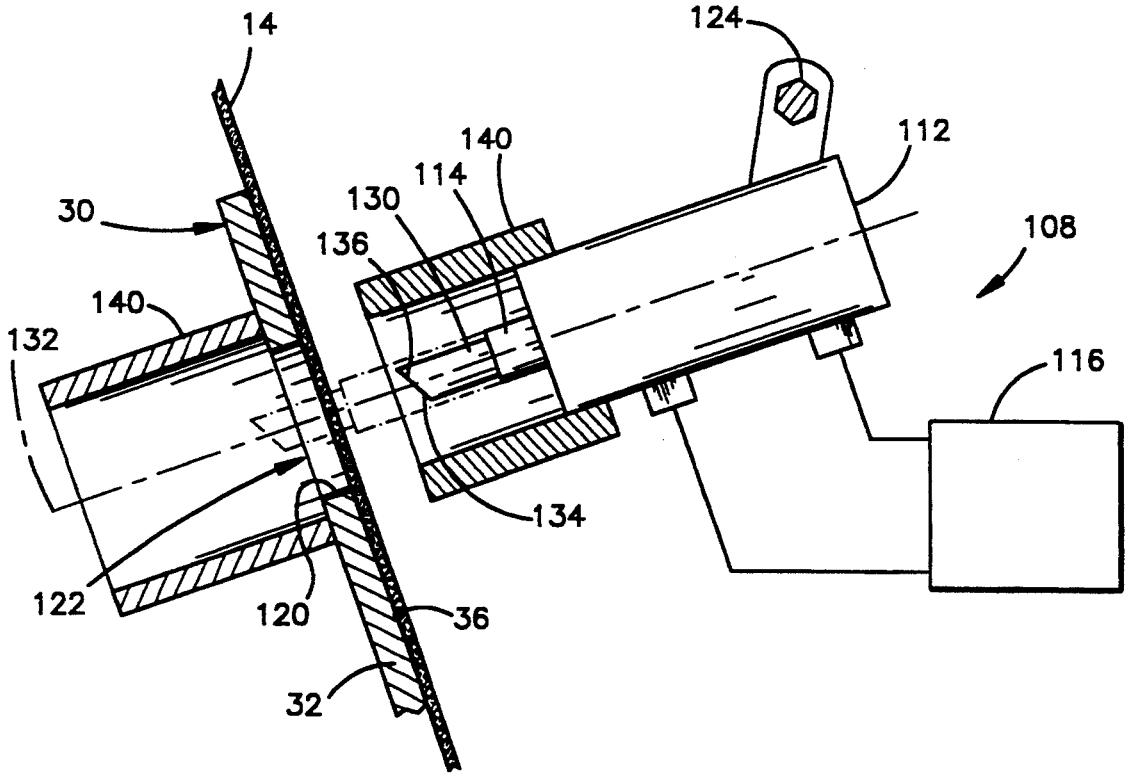
FIG. 5 is an enlarged partial view of parts of the apparatus of FIG. 1.

The web breaking assembly 108 is shown in greater detail in FIG. 5. The web breaking assembly 108 includes a pneumatic pressure cylinder 112 with a piston rod 114. The cylinder 112 communicates with a source 116 of pneumatic pressure. The piston rod 114 is movable into and out of the cylinder 112 under the influence of pneumatic pressure directed to the cylinder 112 from the source 116. As further shown in FIG. 5, the former board 30 has an inner edge surface 120 which defines a circular opening 122 extending through the upper end portion 32 of the former board 30. The cylinder 112 is supported over the opening 122 by a cross bar 124 which extends across the folder 18 between the side frames of the folder 18.

The web breaking assembly 108 further includes a punch member 130. The punch member 130 has an elongated cylindrical shape which is centered on a longitudinal axis 132, and has a planar end surface 134 which is defined within a peripheral cutting edge surface 136. The end surface 134 preferably extends across the longitudinal axis 132 at an acute angle as shown in FIG. 5, with the end surface 134 and the peripheral cutting edge surface 136 having elliptical shapes. However, the end surface 134 could alternatively be perpendicular to the longitudinal axis 132, in which case the end surface 134 and the peripheral cutting edge surface 136 would both have circular shapes.

The punch member 130 is supported on the piston rod 114 to move with the piston rod 114. The punch member 130 is movable with the piston rod 114 back and forth between a retracted position in which the punch member 130 is spaced outward from the opening 122, as shown in solid lines in FIG. 5, and an extended position in which the punch member 130 extends through the opening 122, as shown in dashed lines in FIG. 5. The punch member 130 penetrates the web 14 and punches a hole through the web 14 in the shape of the end surface 134 upon moving from the retracted position to the extended position. Cylindrical safety guards 140 are located in appropriate positions.

Figure 6:
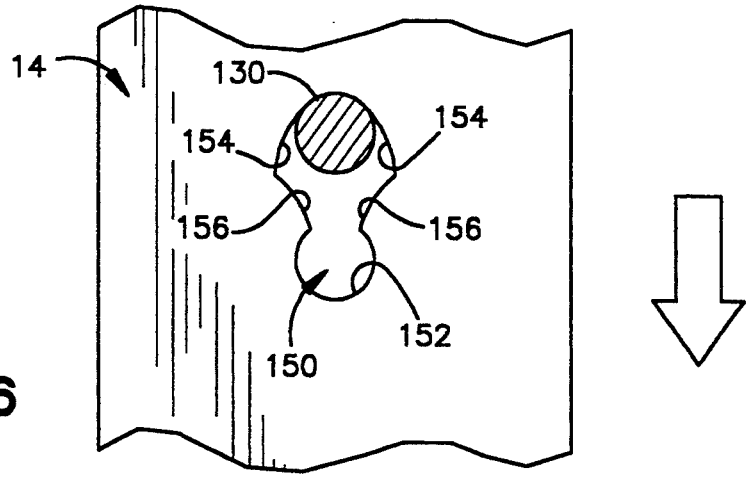
FIGS. 6–8 are schematic views illustrating operation of parts of the apparatus of FIG. 1.
Figure 7:
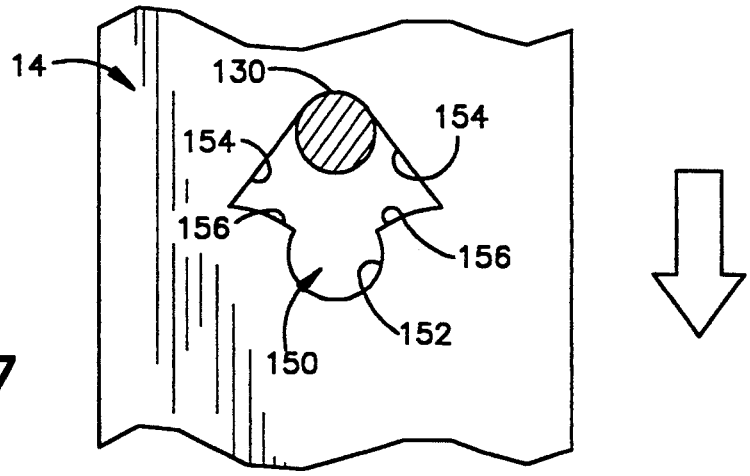
Figure 8:
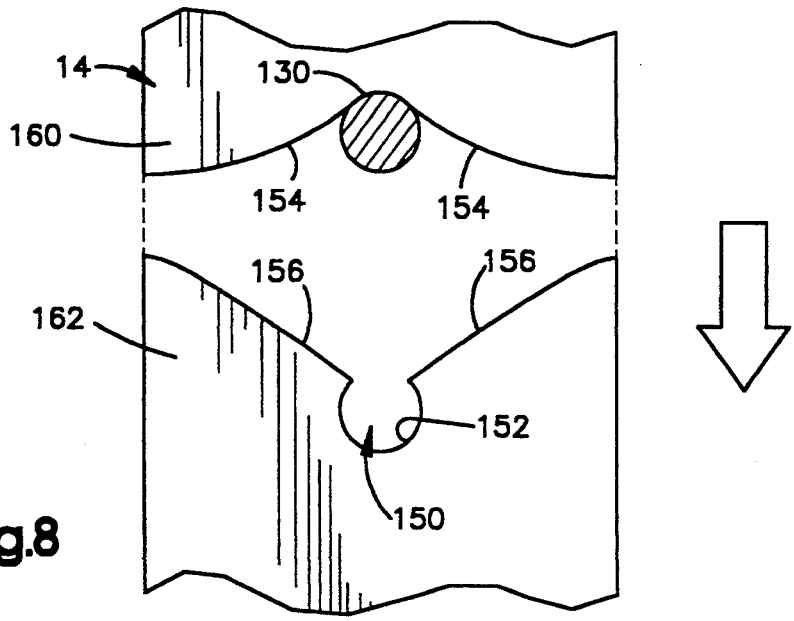

When the punch member 130 punches a hole through the web 14, it weakens the web 14 sufficiently for the tension in the web 14 to tear the web 14 into separate sections. As shown schematically in FIGS. 6–8, the punch member 130 first punches a hole 150 through the web 14 in the shape of the end surface 134 of the punch member 130. The hole 150 is thus defined within an inner edge surface 152 of the web 14 which has the shape of the cutting edge surface 136 of the punch member 130. As the tension in the web 14 moves the web 14 in the direction of the arrow shown in FIG. 6, the hole 150 moves downward from the punch member 130. The tension in the web 14 thus forms torn inner edge surfaces 154 and 156 of the web 14. The torn inner edge surfaces 154 and 156 extend and diverge transversely from the punch member 130 and the hole 150, respectively, toward the opposite longitudinal side edges of the web 14 as the tension in the web 14 continues to tear the web 14 from the condition shown in FIG. 6 to the condition shown in FIG. 7. The torn inner edge surfaces 154 and 156 eventually reach the opposite longitudinal side edges of the web 14 as shown in FIG. 8, at which point the web 14 is torn into separate sections 160 and 162. The amount of tension remaining in the web 14 after the controller 104 interrupts operation of the drive assembly 106, as well as any small amount of continued movement of the web 14 which is incidental to interruption of the drive assembly 106, is sufficient to tear the web 14 into the separate sections 160 and 162 in the foregoing manner.

The preferred embodiment of the present invention has been described with reference to a single web breaking assembly 108. However, additional web breaking assemblies 170 like the web breaking assembly 108 could be provided, as shown in dashed lines in FIG. 3. Each of the additional web breaking assemblies 170 would be located on the cross bar 124 in alignment with a respective opening 122 in the former board 30. The amount of tension in the web 14 and/or the amount of movement of the web 14 required to tear the web 14 into separate sections would be reduced in accordance with the number of additional web breaking assemblies 170 and the corresponding number of additional torn inner edge surfaces which would be formed in the web 14. Moreover, the former board 30 is most preferably formed with a plurality of the openings 122, as shown in FIG. 3, so that the web breaking assembly 108 can be moved between different positions relative to the width of the web 14 either alone or in combination with one or more of the additional web breaking assemblies 170.

From the above description of the invention, those skilled in the art will perceive improvements, changes and modifications. Such improvements, changes and modifications within the skill of the art are intended to be covered by the appended claims.

Having described the invention, the following is claimed:

1. Apparatus for intentionally breaking a web in a printing press which moves the web and signatures formed from the web, said apparatus comprising:

an elongated punch member (130) having a longitudinal axis (132), a planar end surface (134) extending across said axis (132), and a peripheral edge surface (136) defining the peripheral shape of said end surface (134);

die means (30) having a planar web guide surface (36) and an inner edge surface (120) defining a die opening (122) at said planar web guide surface (36);

drive means (106) for moving the web (14) along a path of movement extending across said planar web guide surface (36);

reciprocating means (112) for moving said punch member (130) back and forth between a retracted position in which said punch member (130) is spaced from said path of movement and an extended position in which said punch member (130) extends across said path of movement and into said die opening (122);

fault detecting means (100) for detecting a fault condition of the web (14) or signature flow when the web (14) of signature is being moved along its path of movement by said drive means (106); and actuating means (104) for causing said reciprocating means (112) to move said punch member (130) from said retracted position to said extended position in response to detection of said fault condition by said fault detecting means (100), said actuating means (104) thus causing said punch member (130) to punch a hole (150) through the web (14) which has said peripheral shape of said end surface (134) of said punch member;

said drive means (106) imparting tension to the web (14) which urges the web (14) to move along said path of movement past said punch member (130) when said punch member (130) is in said extended position, said drive means (106) thus cooperating with said punch member (130) to tear the web (14) into sections (160,162) that extend longitudinally from said punch member (130) in opposite directions along said path of movement.

2. Apparatus as defined in claim 1 wherein said die means (30) further has a triangular folding board surface (36) which is contiguous with said planar web guide surface (36).

3. Apparatus as defined in claim 2 wherein said punch member (130) has a cylindrical shape with said peripheral edge surface (136) extending circumferentially around said axis (132).

4. Apparatus as defined in claim 3 wherein said peripheral shape of said end surface (134) of said punch member (130) is elliptical.

* * * * *